US010059503B2

(12) United States Patent
Stuart

(10) Patent No.: US 10,059,503 B2
(45) Date of Patent: Aug. 28, 2018

(54) CONTOURED ICE PACK SYSTEM FOR A FISH BODY

(71) Applicant: Kevin R Stuart, Kissimmee, FL (US)

(72) Inventor: Kevin R Stuart, Kissimmee, FL (US)

( * ) Notice: Subject to any disclaimer, the term of this patent is extended or adjusted under 35 U.S.C. 154(b) by 92 days.

(21) Appl. No.: 14/701,501

(22) Filed: Apr. 30, 2015

(65) Prior Publication Data

US 2016/0316772 A1 Nov. 3, 2016

(51) Int. Cl.

*F25D 3/08* (2006.01)
*B65D 81/38* (2006.01)
*B65D 25/04* (2006.01)

(52) U.S. Cl.

CPC ..... *B65D 81/3813* (2013.01); *B65D 25/04* (2013.01); *B65D 81/382* (2013.01); *F25D 3/08* (2013.01); *F25D 2303/082* (2013.01)

(58) Field of Classification Search

CPC .... B65D 81/382; F25D 2303/082; F25D 3/08
See application file for complete search history.

(56) References Cited

U.S. PATENT DOCUMENTS

| | | | | |
|---|---|---|---|---|
| D268,074 | S | 3/1983 | Burg et al. | |
| 5,377,855 | A | 1/1995 | Cook, Jr. et al. | |
| 5,901,571 | A * | 5/1999 | Whaley | F25D 3/08 62/457.5 |
| 6,185,860 | B1 | 2/2001 | Thibodeaux | |
| 7,389,608 | B1 | 6/2008 | MacKay | |
| 7,427,001 | B1 * | 9/2008 | Keitges | B65D 81/382 220/4.24 |
| 8,621,885 | B1 * | 1/2014 | Niebolte | F25D 31/002 62/457.4 |
| 2005/0235683 | A1 * | 10/2005 | Fiene | F25D 3/08 62/457.5 |

FOREIGN PATENT DOCUMENTS

| | | | |
|---|---|---|---|
| CN | 202657464 | 1/2013 | |
| EP | 1010957 | 6/2000 | |
| EP | 1591732 | * 11/2005 | F25D 3/08 |

OTHER PUBLICATIONS alltackle.com, Sea Angler Fish and Bait Soft Cooler Bags, viewed at: http://www.alltackle.com/ sea_angler_fish_bags.html on Jan. 31, 2015.

Rubbermaid, Lunch Blox Sandwich Kit, viewed at: http://www.rubbermaid.com/en-US/lunchblox%E2%84%A2-sandwich-kit on Feb. 2, 2015.

Outdoorsmadeeasy, Grizzly 75qt Individual Ice Packs, viewed at: http://outdoorsmadeeasy.com/store/index.php?route=product/product&product_id=608 on Feb. 2, 2015.

amazon.com, 6 Pack Freez Kollant Can Cooler Pack Gel Cold Ice Substiute Hold 6 Soda Beer 2Pc, viewed at: http://www.amazon.com/Pack-Freez-Kollant-Cooler-Substiute/dp/B00CKZ9DBK on Jan. 31, 2015.

* cited by examiner

*Primary Examiner* — Orlando E Aviles Bosques
(74) *Attorney, Agent, or Firm* — Law Office of Steven R. Olsen, PLLC; Steven R. Olsen

(57) ABSTRACT

Embodiments of the invention provide rigid (hard-sided) ice packs that include contours configured to cooperate with whole fish, as harvested. The contours allow the fish to have close contact with surfaces of the ice pack while also protecting the fish from being bruised, crushed, deformed, or otherwise damaged during storage or transportation.

7 Claims, 7 Drawing Sheets

CONTOURED ICE PACK SYSTEM FOR A FISH BODY

BACKGROUND

Field of Invention

The invention relates generally to refrigeration. In particular, but not by way of limitation, the invention relates to reusable ice packs that can be used to store or transport fish in a cooler or other insulated container.

Description of the Related Art

Many varieties of ice packs (a/k/a cooler packs or gel packs) are known. Such containers are typically reusable, and may be filled, for example, with water (with or without propylene glycol, alcohol, and/or other additives) or a refrigerant gel. Prior to use, a filled ice pack is placed in a freezer. Once the contents of the ice pack are frozen, the ice pack can be used, for instance, in a cooler or other insulated container to temporarily keep perishable foods or other items cool.

Conventional ice packs have some disadvantages, however. One shortcoming is that ice packs are typically brick-shaped and rigid. As a consequence, certain perishable foods (such as fresh fish) can be easily bruised, crushed, or otherwise damaged when being cooled by ice packs. In addition, the effects of rigor mortis can leave fish in a curled state, which makes filleting or other processing more difficult. Such risks are not mitigated by soft-sided ice packs because fish can be crushed or bent under the weight of such ice packs and/or other cooler contents. An improved device is needed for temporarily cooling fish or other fragile items.

SUMMARY OF THE INVENTION

The invention seeks to overcome one or more of the limitations described above. Embodiments of the invention provide rigid (hard-sided) ice packs that include contours configured to cooperate with whole fish, as harvested. The contours allow the fish to have close contact with surfaces of the ice pack while also protecting the fish from being bruised, crushed, deformed, or otherwise damaged during storage or transportation. These and other features and benefits are more fully described in the detailed description section below.

BRIEF DESCRIPTION OF THE DRAWINGS

Embodiments of the invention are described with reference to the following drawings, wherein.

DETAILED DESCRIPTION

Figure 1:
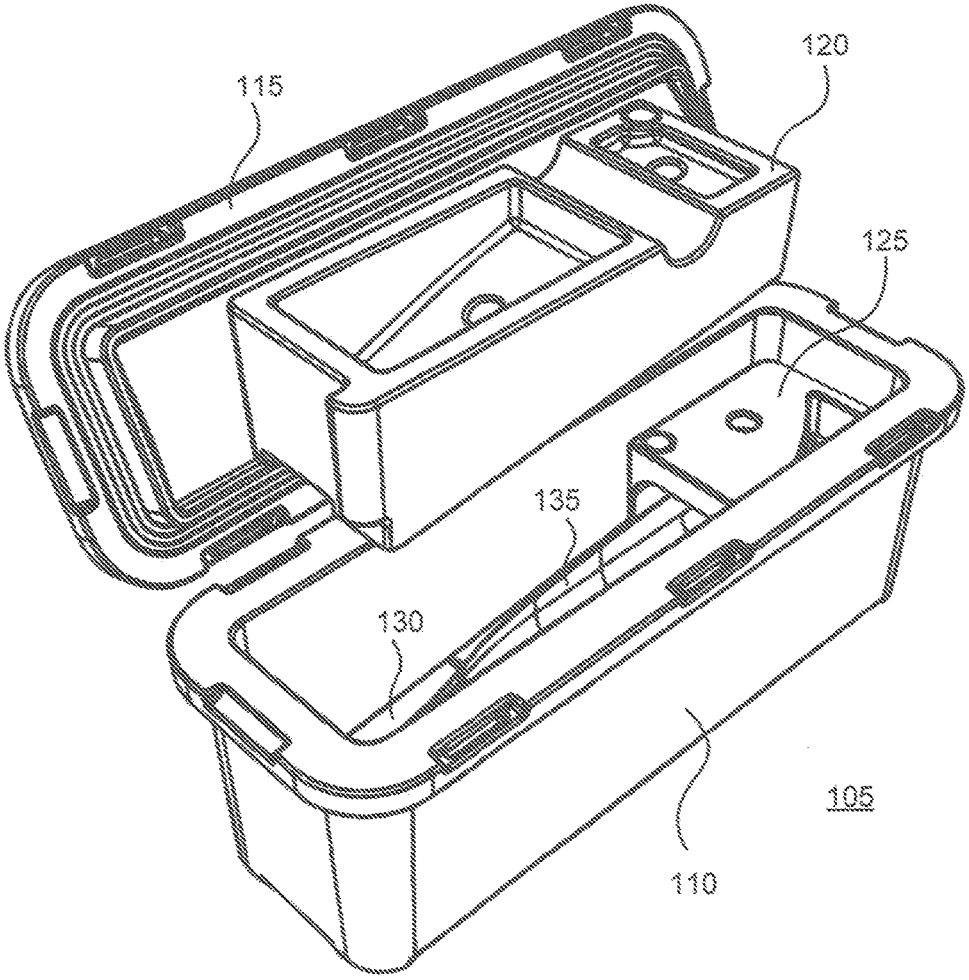
FIG. 1 is a perspective view of a red drum fish ice pack system according to a first embodiment of the invention.

Embodiments of the invention are described below with reference to FIGS. 1-12. Reference designators are reused for the same or similar features. The drawings are not necessarily to scale. Some features illustrated in the drawings may be exaggerated for descriptive clarity.

Red Drum Fish Embodiment

FIGS. 1-5 provide perspective views of a red drum fish ice pack system according to a first embodiment of the invention. As illustrated in FIG. 1, a marine cooler 105 contains four ice packs 120, 125, 130, and 135 within its thermally-insulated cooler body 110 and lid 115. Each of the four ice packs 120, 125, 130, and 135 are preferably substantially rigid plastic (e.g., blow molded high-density polyethylene) containers and can be filled, for example, with water (with or without propylene glycol, alcohol, and/or other additives) or a refrigerant gel. As used herein, being substantially rigid means the container will hold its shape under normal use. In use, the contents of each ice pack 120, 125, 130, and 135 can be frozen (or at least cooled) prior to use as heat-absorbing devices in the marine cooler 105.

Figure 2:
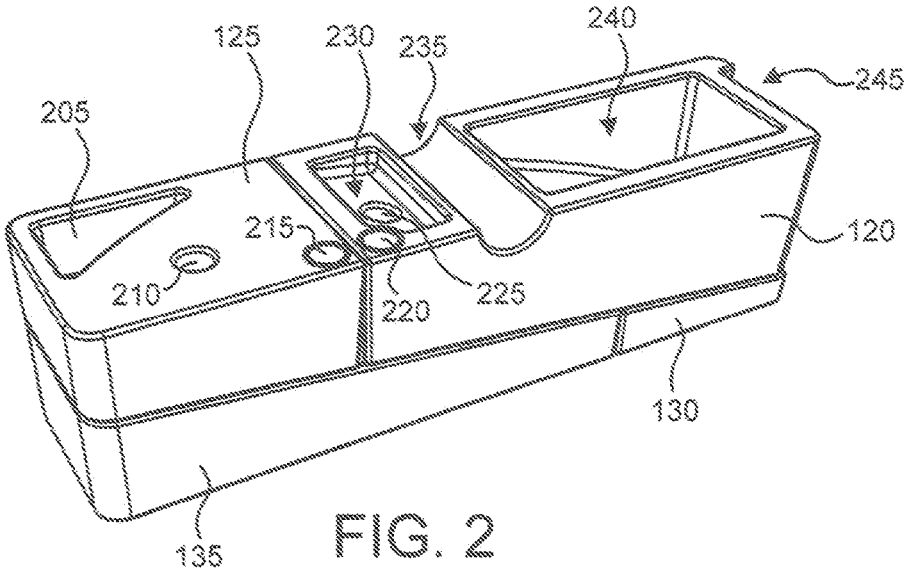
FIG. 2 is a perspective view of the red drum fish ice pack system according to the first embodiment of the invention.

FIG. 2 shows that the ice packs 120, 125, 130, and 135 cooperate to form a single assembly. Ice packs 120 and 125 form a top cooling layer; ice packs 130 and 135 form a bottom cooling layer. In the illustrated embodiment, each of the ice packs 120, 125, 130, and 135 has a distinct different length ("different" meaning as compared to each of the other ice packs; "length" referring to a longest dimension).

In the illustrated embodiment, ice pack 125 includes a storage compartment 205, thumb hole 210, and filler cap 215. Ice pack 120 includes a filler cap 220, thumb hole 225, storage compartments 230, 235, and 240, and a recess 245. Each of the storage compartments 205, 230, and 240 can be used, for instance, to store snack food or bait. The storage compartment 235 is shaped to cradle a can or bottle. The thumb holes 210, 225 facilitate removal of the ice packs from the marine cooler 105. In embodiments of the invention, the filler caps 215, 220 may be permanently sealed, for instance after refrigerant gel has been added during manufacturing; in other embodiments, the filler caps 215, 220 may be threaded for convenient insertion into and removal from associated holes in the ice packs 125, 120. The purpose of the recess 245 will be described below with reference to FIG. 4.

Figure 3:
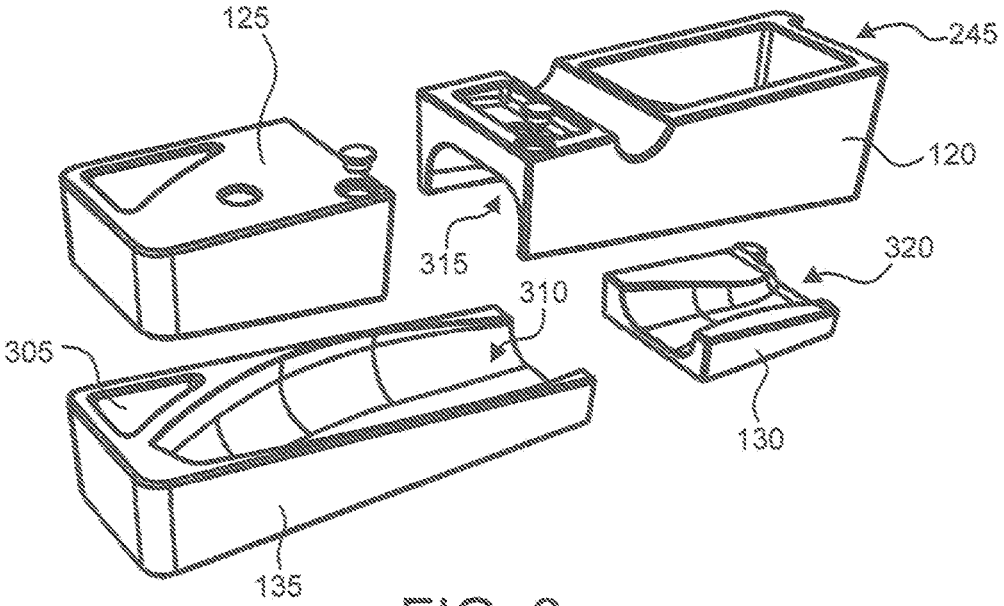
FIG. 3 is a perspective view of the red drum fish ice pack system according to the first embodiment of the invention.

FIG. 3 is an exploded view of the ice pack assembly. Partitioning the top cooling layer into ice packs 120, 125 and the bottom cooling layer into ice packs 130, 135 permits each ice pack to be a relatively small size. The relatively small size may be advantageous when cooling each of the ice packs 120, 125, 130, 135, for instance, in the freezer compartment of a residential refrigerator prior to use. FIG. 3 also illustrates a storage compartment 305 and a concave contour 310 in the ice pack 135, a concave contour 320 in the ice pack 130, and a concave contour 315 in the ice pack 120. A concave contour 540 (visible in FIG. 5) also exists in the ice pack 125.

Figure 4:
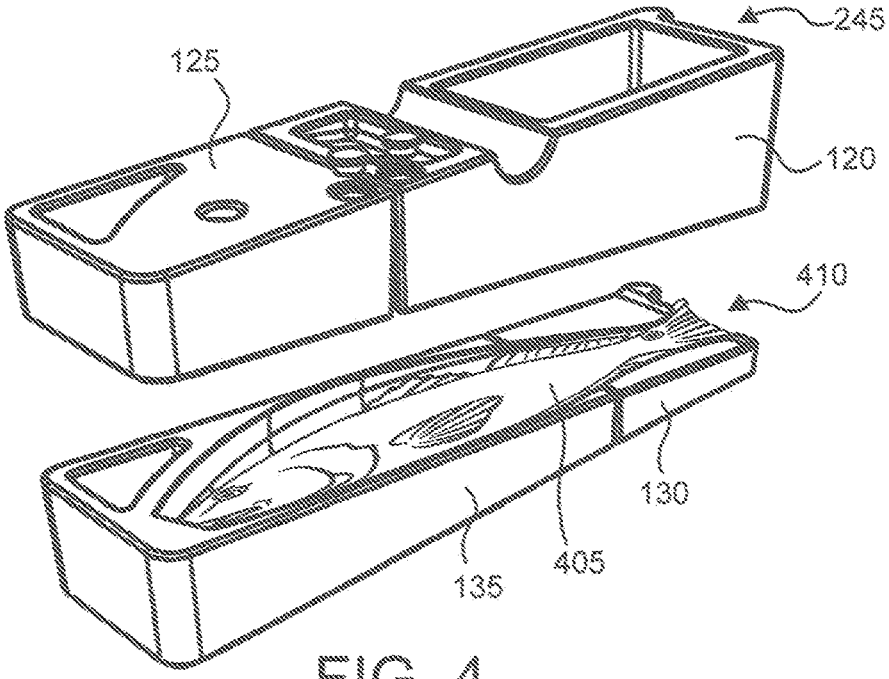
FIG. 4 is a perspective view of the red drum fish ice pack system according to the first embodiment of the invention.

FIG. 4 illustrates a red drum fish 405 cradled by the concave contours 310 and 320. Concave contours 315 and 540 keep cooling surfaces of the ice packs 120, 125 close to a top surface of the red drum fish 405, while also providing a protective canopy to minimize bruising, crushing, or undesirable deformation of the fish body. FIG. 4 thus illustrates that each of the contours 310, 320, 315, and 540 have a shape that is complementary with respect to a corresponding portion of the red drum fish 405. In the case of a large red drum fish 405 (larger than the one illustrated in FIG. 4), a tail end 410 of the red drum fish 405 may be folded into the recess 245 of the ice pack 120. The illustrated concave contours 310, 320, 315, 540 may be suitable for species of fish other than a red drum fish 405, for example large and small mouth bass. In an alternative embodiment, each of the concave contours 310, 320, 315, 540 could be altered to be complementary in shape with respect to a corresponding portion of another species of fish.

Figure 5:
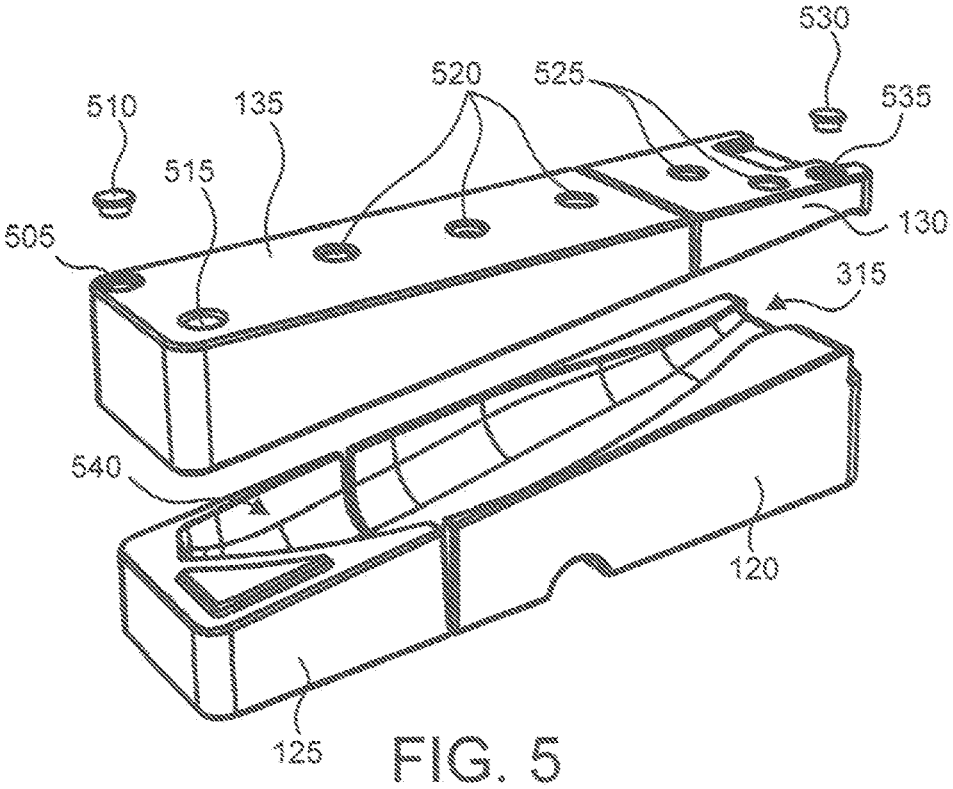
FIG. 5 is a perspective view of the red drum fish ice pack system according to the first embodiment of the invention.

The perspective view in FIG. 5 illustrates a bottom side of each of the ice packs 120, 125, 130, 135. A bottom side of the ice pack 135 includes a filler hole 505, cooperating filler cap 510, and structural support features 515 and 520. A bottom side of the ice pack 130 likewise includes a filler hole 535, cooperating filler cap 530, and structural support features 525. In embodiments of the invention, the filler caps 510, 530 may be permanently sealed in the corresponding hole, for instance after refrigerant gel has been added during manufacturing.

Figure 13:
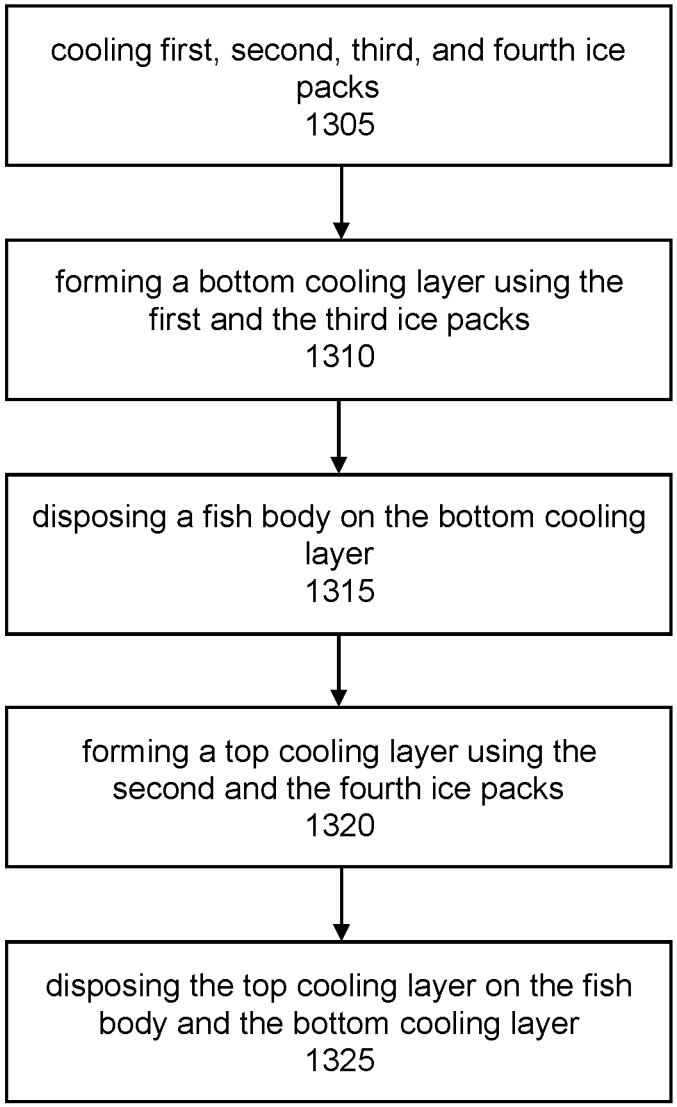
FIG. 13 is a flow diagram of a method for using an ice pack system, according to an embodiment of the invention.

FIG. 13 is a flow diagram of a method for using an ice pack system, according to an embodiment of the invention. The illustrated method includes: cooling first, second, third, and fourth ice packs in step 1305; forming a bottom cooling layer using the first and the third ice packs in step 1310; disposing a fish body on the bottom cooling layer in step 1315; forming a top cooling layer using the second and the fourth ice packs in step 1320; and disposing the top cooling layer on the fish body and the bottom cooling layer in step 1325.

Variations to the red drum fish embodiment illustrated in FIGS. 1-5 and described above are possible. For instance, in an alternative embodiment, the top layer formed by ice packs 120, 125 could be constructed using a single ice pack or by using more than two ice packs, according to design choice. Likewise, in an alternative embodiment, the bottom layer formed by ice packs 130, 135 could be constructed using a single ice pack or by using more than two ice packs. It may be possible to omit the concave contours in the ice pack(s) that form the top layer or in the ice packs(s) that form the bottom layer, so long as the concave contours of the opposing layer are sufficiently deep to avoid damage to the target fish. The quantity and shape of storage compartments 205, 230, 235, 240, and 305 could be varied, or omitted altogether, based on application needs. In other embodiments, the thumb holes 215, 220 could be relocated or omitted. The need for internal structural support features 515, 520, and 525 could vary based on material choice and the thickness of ice pack walls.

Flounder Embodiment

Figure 6:
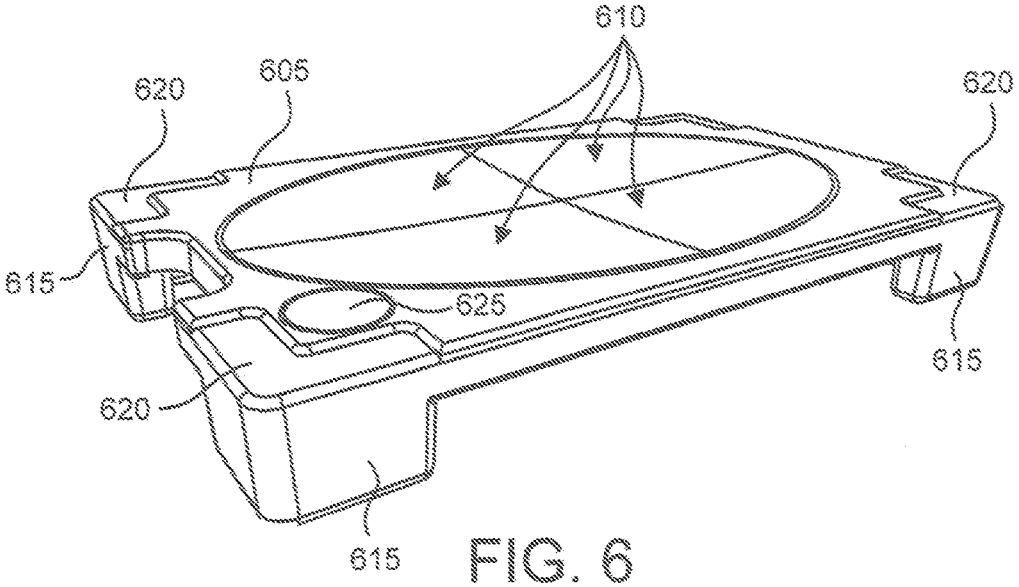
FIG. 6 is a perspective view of a flounder ice pack according to a second embodiment of the invention.

FIGS. 6-9 provide perspective views of a flounder ice pack system according to a second embodiment of the invention. As illustrated in FIG. 6, a top surface of an ice pack tray 605 includes a concave contour 610, stacking notches 620, and a filler cap 625. Legs 615 extend from a bottom surface of the ice pack tray 605. The ice pack tray 605 is preferably a substantially rigid plastic (e.g., blow molded high-density polyethylene) container and can be filled, for example, with water (with or without propylene glycol, alcohol, and/or other additives) or a refrigerant gel. In use, the contents of ice pack tray 605 can be frozen (or at least cooled) prior to use as a heat-absorbing device in a cooler or other thermally-insulated container.

In embodiments of the invention, the filler cap 625 may be permanently sealed, for instance after refrigerant gel has been added during manufacturing; in other embodiments, the filler cap 625 may be threaded for convenient insertion into and removal from a cooperating filling hole (not shown) in the ice pack 605. The purpose of the stacking notches 620 will be described below with reference to FIG. 9.

Figure 7:
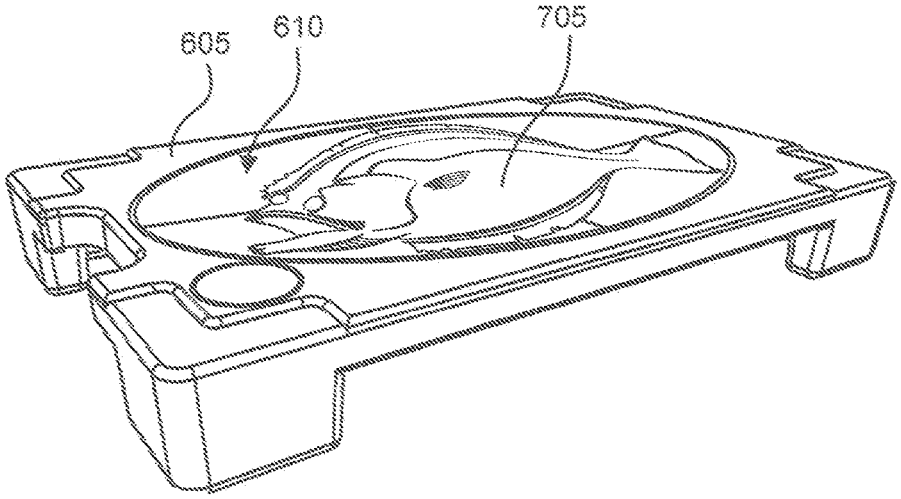
FIG. 7 is a perspective view of the flounder ice pack according to the second embodiment of the invention.

FIG. 7 illustrates a flounder 705 cradled by the concave contour 610 of the ice pack tray 605. The concave contours 605 may be suitable for species of fish other than a flounder 705. In an alternative embodiment, the concave contours 605 could be altered to accommodate a species of fish other than flounder.

Figure 8:
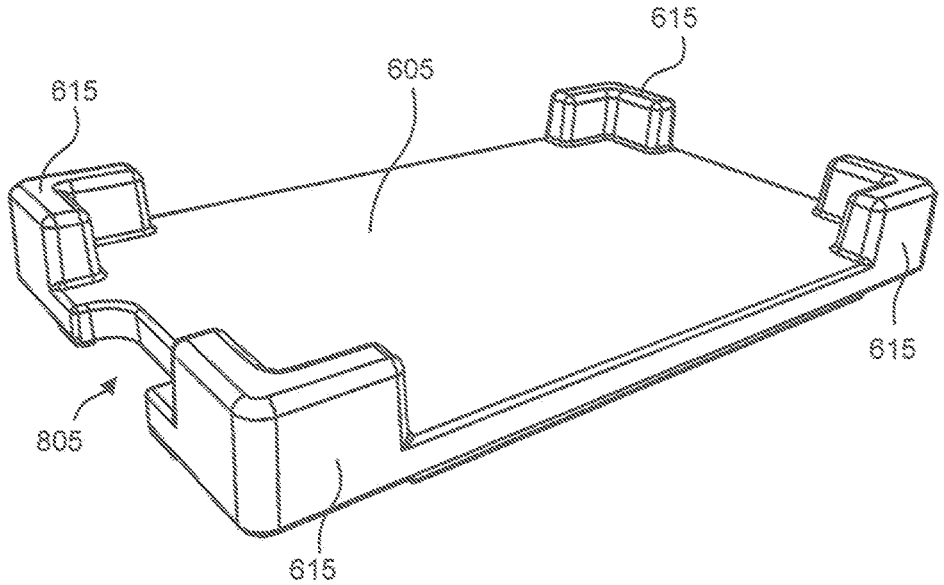
FIG. 8 is a perspective view of the flounder ice pack according to the second embodiment of the invention.
Figure 9:
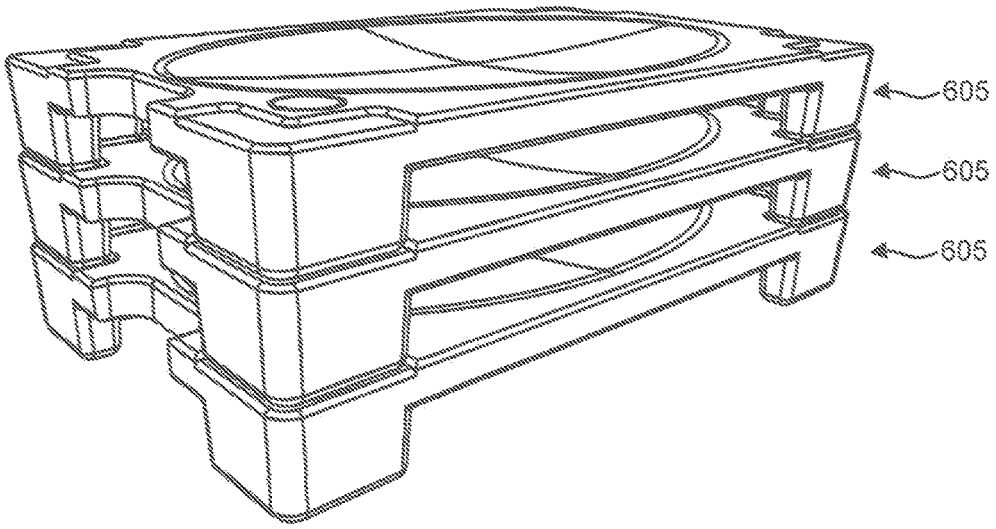
FIG. 9 is a perspective view of a stack of flounder ice packs according to the second embodiment of the invention.

The perspective view in FIG. 8 illustrates a bottom side of the ice pack tray 605, and identifies handhold 805 that facilitates installation and removal of the ice pack tray 605 from the cooler or other insulated container. Two or more ice pack trays 605 can be stacked as shown in FIG. 9; the legs 615 of one ice pack tray 605 cooperate with the stacking notches 620 of another ice pack tray 605. In use, legs 615 prevent a flounder that is disposed under an ice pack tray 605 from being bruised, crushed, or deformed in a way that would later complicate the fillet process.

Variations to the flounder embodiment illustrated in FIGS. 6-9 and described above are possible. For instance, in an alternative embodiment, handholds 805 may be disposed on two or more sides of the ice pack tray 605. The handhold 805 could also be omitted, according to application demands. Other embodiments could use fewer than four legs, or more than four legs, to maintain spacing between stacked tray surfaces. In other embodiments, alternative stacking features, such as cooperating pins and holes, could be used in the place of stacking notches 620.

Crappie Embodiment

Figure 10:
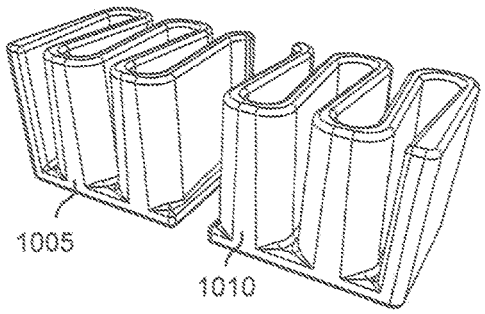
FIG. 10 is a perspective view of two crappie ice packs according to a third embodiment of the invention.
Figure 11:
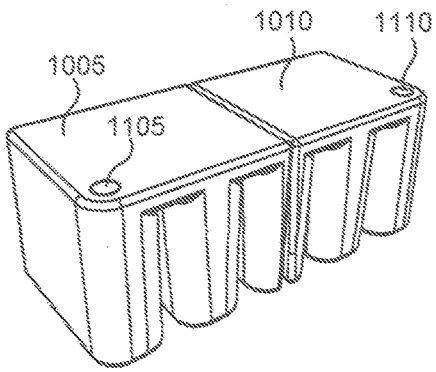
FIG. 11 is a perspective view of a two crappie ice packs according to the third embodiment of the invention.
Figure 12:
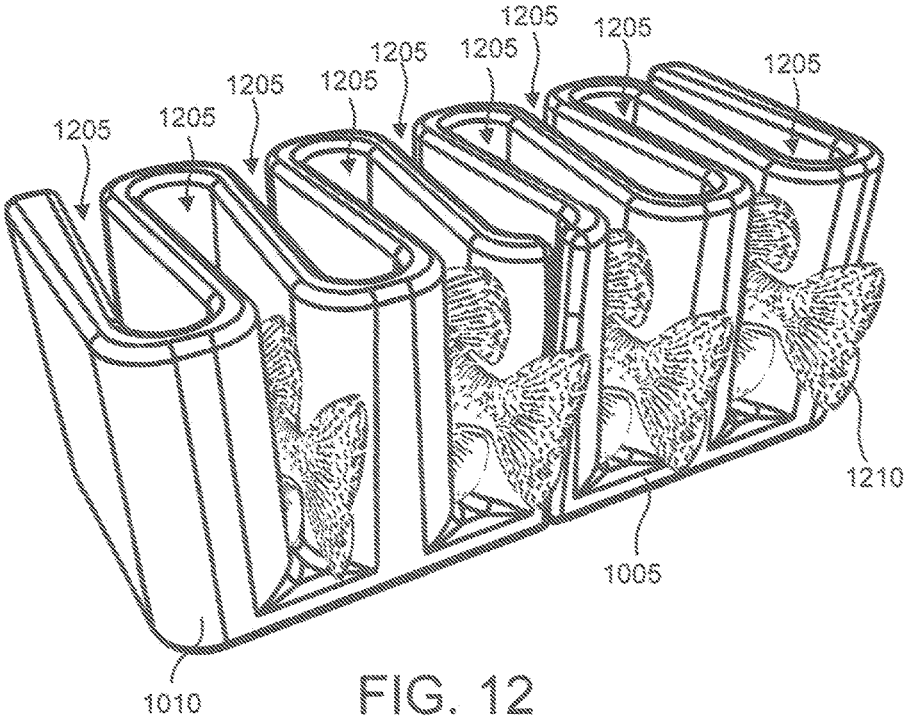
FIG. 12 is a perspective view of two crappie ice packs according to the third embodiment of the invention.

FIGS. 10-12 provide perspective views of a crappie ice pack system according to a third embodiment of the invention. FIG. 10 illustrates two ice packs 1005, 1010, that can cooperate to form a single ice pack system. Each of the ice packs 1005, 1010, has a serpentine cross section. Each of the ice packs 1005, 1010, is preferably a substantially rigid plastic (e.g., blow molded high-density polyethylene) container and can be filled, for example, with water (with or without propylene glycol, alcohol, and/or other additives) or a refrigerant gel. In use, the contents of ice packs 1005, 1010 can be frozen (or at least cooled) prior to use as a heat-absorbing device in a cooler or other thermally-insulated container.

As shown in FIG. 11, a bottom surface of the ice pack 1005 includes a filler cap 1105, and a bottom surface of the ice pack 1010 includes a filler cap 1110. In embodiments of the invention, the filler caps 1105, 1110 may be permanently sealed, for instance after refrigerant gel has been added during manufacturing; in other embodiments, the filler caps 1105, 1110 may be threaded for convenient insertion into and removal from cooperating filling holes (not shown).

FIG. 12 illustrates that the serpentine cross section of the ice packs 1005, 1010, forms pockets 1205. Each of the pockets 1205 can both cool and protect a crappie 1210.

Variations to the crappie embodiment illustrated in FIGS. 10-12 and described above are possible. For example, in an alternative embodiment, the assembly with a serpentine cross section can be formed with a single ice pack having a serpentine cross section or with more than two such ice packs. In alternative embodiments, the dimensions and proportion of pockets 1205 could be varied to accommodate species of fish other than crappie, for instance blue gill.

Summary

Embodiments of the invention thus provide ice packs that are configured to both cool and protect fish or other fragile targets. Those skilled in the art can readily recognize that numerous variations and substitutions may be made in the invention, its use and its configuration to achieve substantially the same results as achieved by the embodiments described herein. For instance, materials other than plastic could be used to construct ice pack containers, and, in use, the disclosed ice packs can be filled with a variety of alternative heat exchange fluids, solids, or gels. Accordingly, there is no intention to limit the invention to the disclosed exemplary forms. Many variations, modifications and alternative constructions fall within the scope and spirit of the disclosed invention.

I claim:

1. An ice pack system for a fish body of a target fish species comprising:

a first ice pack, the first ice pack being substantially rigid, a surface of the first ice pack including a first contour, the first contour being concave and disposed on a top surface of the first ice pack, the first contour being a complementary shape with respect to a first portion of the fish body;

a second ice pack, the second ice pack being substantially rigid, a surface of the second ice pack including a second contour, the second contour being concave and disposed on a bottom surface of the second ice pack, the second contour being a complementary shape with respect to a second portion of the fish body;

a third ice pack, the third ice pack being substantially rigid, a surface of the third ice pack including a third contour, the third contour being concave and disposed on a top surface of the third ice pack, the third contour being a complementary shape with respect to a third portion of the fish body; and a fourth ice pack, the fourth ice pack being substantially rigid, the fourth ice pack including a fourth contour, the fourth contour being concave and disposed on a bottom surface of the fourth ice pack, the fourth contour being a complementary shape with respect to a fourth portion of the fish body, the first, second, third, and fourth contours being different from each other, the first and third ice packs cooperating to form a bottom layer in use, the second and fourth ice packs cooperating to form a top layer in use, such that the first, second, third, and fourth portions of the fish body can be disposed in a cavity formed by the first, second, third, and fourth contours.

2. The ice pack system of claim 1, further comprising:

a first storage compartment disposed in a top surface of the second ice pack; and a second storage compartment disposed in a top surface of the fourth ice pack.

3. The ice pack system of claim 1, further comprising:

a first thumb hole disposed in a top surface of the second ice pack; and a second thumb hole disposed in a top surface of the fourth ice pack.

4. The ice pack system of claim 1, a first filler cap disposed in a bottom surface of the first ice pack;

a second filler cap disposed in a top surface of the second ice pack;

a third filler cap disposed in a bottom surface of the third ice pack; and a fourth filler cap disposed in a top surface of the fourth ice pack.

5. The ice pack system of claim 1, wherein each of the first, second, third, and fourth ice packs has a different length.

6. The ice pack system of claim 1, wherein the target fish species is a red drum fish, the fish body being a red drum fish body, the first contour being a complementary shape with respect to a first portion of the red drum fish body, the second contour being a complementary shape with respect to a second portion of the red drum fish body, the third contour being a complementary shape with respect to a third portion of the red drum fish body, the fourth contour being a complementary shape with respect to a fourth portion of the red drum fish body.

7. A method for using the ice pack system of claim 1, comprising:

cooling each of the first, second, third, and fourth ice packs;

forming a bottom cooling layer using the first and the third ice packs;

disposing the fish body on the bottom cooling layer;

forming a top cooling layer using the second and the fourth ice packs; and disposing the top cooling layer on the fish body and the bottom cooling layer, the method minimizing bruising of the fish body while disposed in the cavity.

* * * * *